United States Patent [19]

Briggs

[11] Patent Number: 5,022,534

[45] Date of Patent: Jun. 11, 1991

[54] GUN LOCKING DEVICE

[76] Inventor: Charles C. Briggs, 403 S. Bell, Big Spring, Tex. 74720

[21] Appl. No.: 475,685

[22] Filed: Feb. 6, 1990

[51] Int. Cl.[5] ..... A47F 7/00

[52] U.S. Cl. ..... 211/4; 70/58; 211/64

[58] Field of Search ..... 211/4, 64; 248/551, 248/553; 70/58, 60, 62, 61

[56] References Cited

U.S. PATENT DOCUMENTS

| | | | |
|---|---|---|---|
| 4,088,228 | 5/1978 | Schwalbe | 211/4 |
| 4,182,453 | 1/1980 | Worswick | 211/64 X |
| 4,328,687 | 5/1982 | Ritchie | 70/58 X |
| 4,624,372 | 11/1986 | Brolin | 211/4 |
| 4,696,405 | 9/1987 | Waring | 211/64 X |

*Primary Examiner*—Robert W. Gibson, Jr.
*Attorney, Agent, or Firm*—Ross, Howison, Clapp & Korn

[57] ABSTRACT

A security rack for weapons includes a housing having an aperture. An elongated slide bar is longitudinally slidably mounted to the housing for movement between an open position and a closed position. The slide bar includes an aperture which is selectively alignable with the housing aperture in the slide bar open position. A locking pin includes a shaft having first and second ends. The first end includes structure for engaging the weapon and the second end passes through the housing aperture and the slide bar aperture when these apertures are aligned in the slide bar open position. The shaft second end includes a notch for engaging the slide bar aperture when the housing aperture and slide bar aperture are misaligned in the closed position to thereby prevent removal of the locking pin from the housing. A locking device engages the slide bar and is accessible through the housing for moving the slide bar between the open and closed positions, thereby allowing insertion and removal of the locking pin from the housing in the open position and locking of the locking pin to the slide bar in the closed position thereby preventing removal of the weapon from the security rack.

7 Claims, 2 Drawing Sheets

GUN LOCKING DEVICE

BACKGROUND OF THE INVENTION

The storage of weapons presents several problems, including securing the weapons against theft as well as preventing access of a weapon to untrained users such as children. Many limited production, custom made, or highly engraved weapons become valuable collector's items and are target for theft. It is not uncommon for a sporting enthusiast to own several weapons and therefore, an inventory of guns may represent a substantial investment. Security branches of local and state law enforcement agencies also possess several weapons which must be stored under security conditions. Security and control of these weapons from unauthorized access is therefore of prime importance.

Efforts to solve problems of providing adequate weapon security have included cabinets, locking racks, security chests or safes, all made of various heavy duty materials. Various retaining devices may be utilized, which may lock all guns to a rack or individually lock single guns. Prior patents disclosing weapons security devices include, for example, U.S. Pat. Nos. 3,917,071; 4,027,798; 4,132,315; 4,174,042; 4,182,453; 4,624,372; 4,696,405; and 4,792,050.

Deficiencies however exist in these security devices in that the attachment mechanism is usually light duty and is easily defeated by a thief. Accordingly, existing devices have not provided high security nor easy and fast access to the stored weapons. A limitation found with multi-weapon racks has been an inability to accommodate different length weapons.

A need has thus arisen for a security rack for multiple weapons which is simple in operation and installation, provides for a high degree of security, and which allows for the display of multiple weapons.

SUMMARY OF THE INVENTION

In accordance with the present invention, a locking mechanism for retaining an object is provided. The locking mechanism includes a housing. A containment device is mounted to the housing for movement between a first position and a second position. The containment device includes an aperture. An object receiving device is provided for engaging the object and the aperture in the containment device. A lock is provided within the housing for moving the containment device between the first and second positions, such that in the first position, the object receiving device is insertable and removable from the aperture, and in the second position of the containment device, the object receiving device and therefore the object is restrained from removal from the housing.

In accordance with another aspect of the present invention, a security rack for weapons includes a housing having an aperture. An elongated slide bar is longitudinally slidably mounted to the housing for movement between an open position and a closed position. The slide bar includes an aperture which is selectively alignable with the housing aperture in the slide bar open position. A locking pin includes a shaft having first and second ends. The first end includes structure for engaging the weapon and the second end passes through the housing aperture and the slide bar aperture when these apertures are aligned in the slide bar open position. The shaft second end includes a notch for engaging the slide bar aperture when the housing aperture and slide bar aperture are misaligned in the closed position to thereby prevent removal of the locking pin from the housing. A locking device engages the slide bar and is accessible through the housing for moving the slide bar between the open and closed positions, thereby allowing insertion and removal of the locking pin from the housing in the open position and locking of the locking pin to the slide bar in the closed position thereby preventing removal of the weapon from the security rack.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
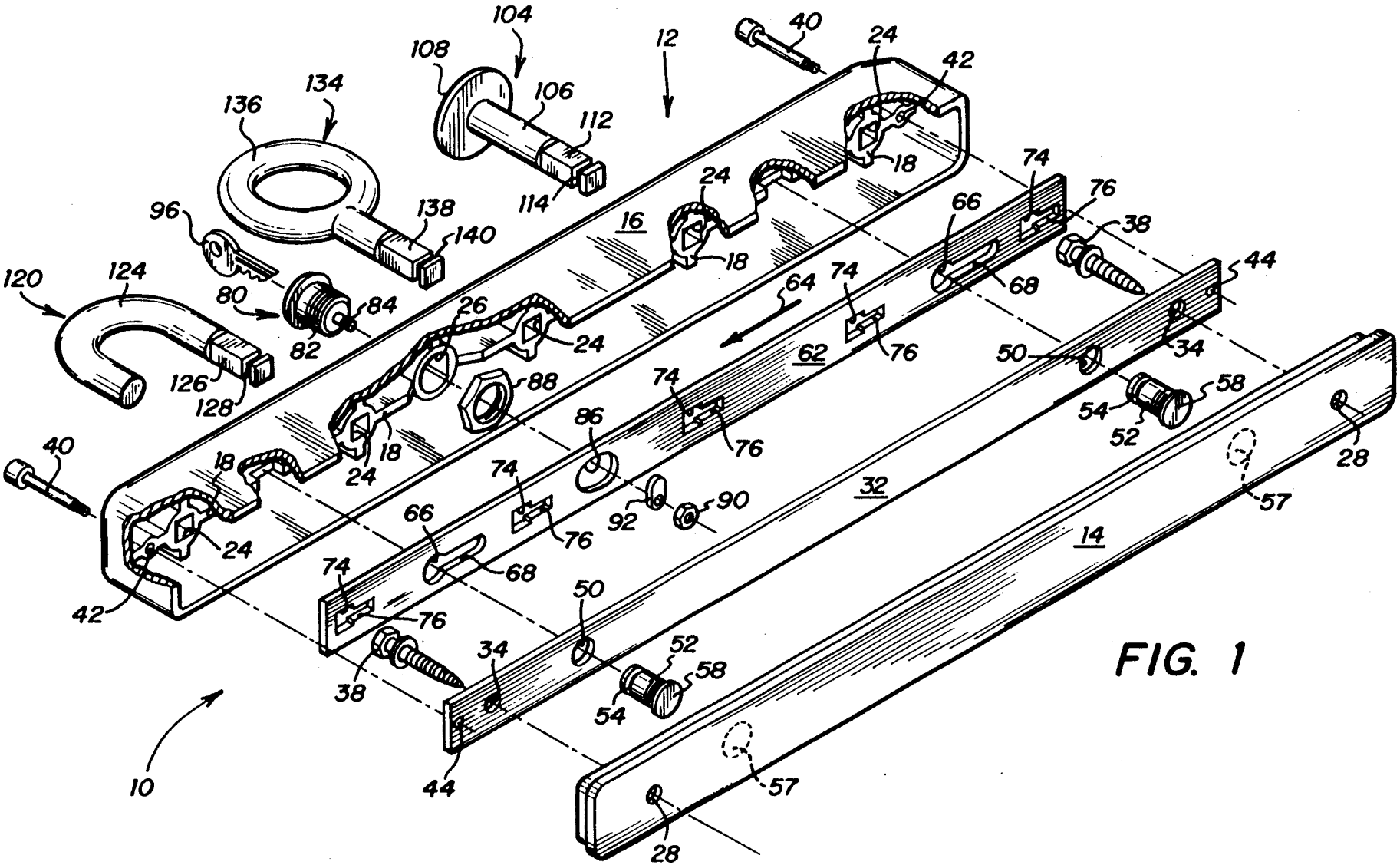
FIG. 1 is an exploded perspective view of the present security rack.
Figure 2:
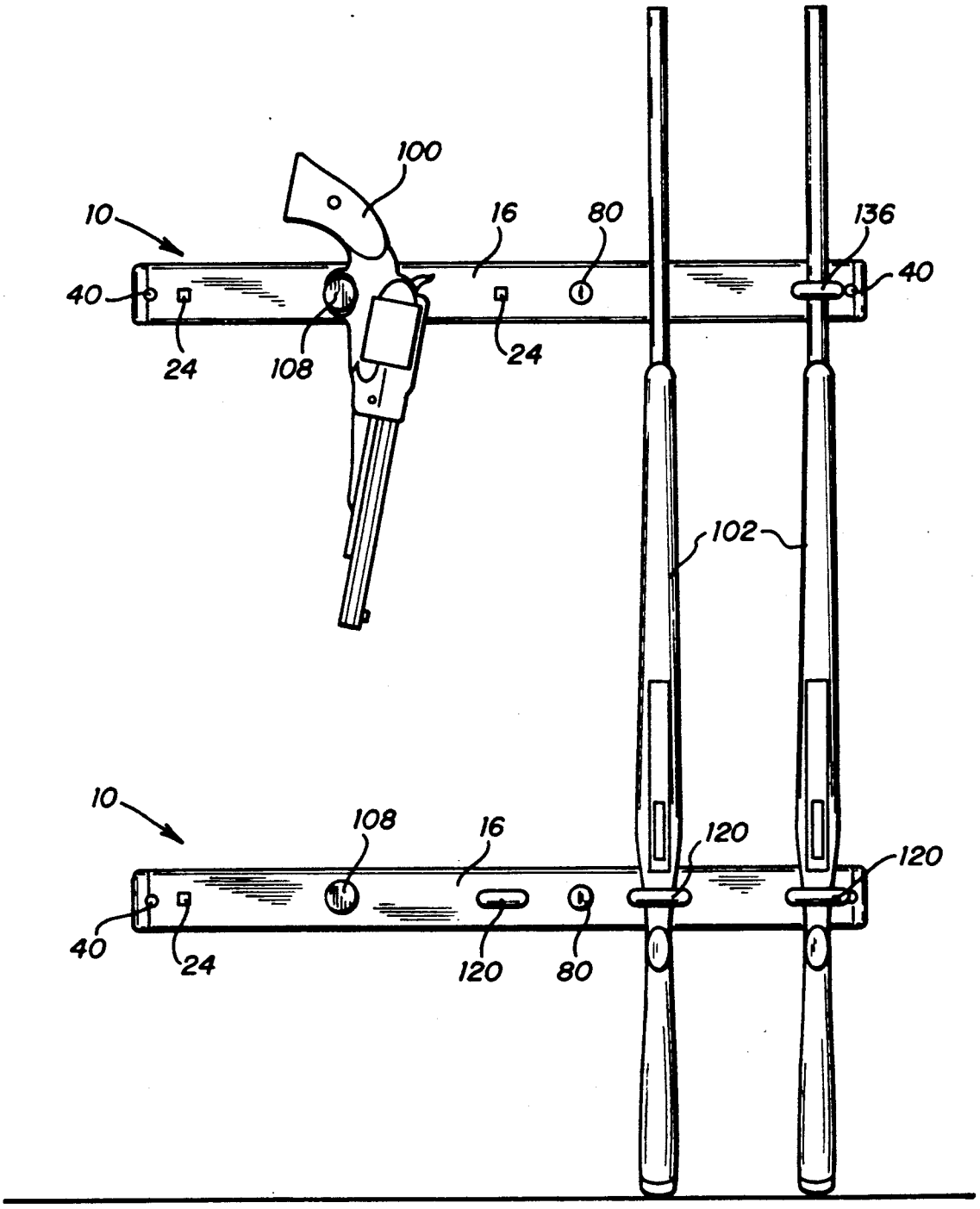
FIG. 2 is a perspective view of the present security rack illustrating several weapons secured thereto.

Referring simultaneously to FIGS. 1 and 2, the present security rack is illustrated, and is generally identified by the numeral 10. Although security rack 10 is illustrated for use with various types of weapons, security rack 10 can be utilized for any type of object which is desired to be displayed and secured from unauthorized removal. Security rack 10 preferably includes housing assembly 12, lock 80 and at least one locking pin as further described below. Housing assembly 12 preferably further comprises front cover 16, slide bar 62, mounting plate 32 and back cover 14. Front cover 16 and back cover 14 are desirably molded from a tough thermoplastic material such as, for example, high impact acrylonitrile butadiene styrene (ABS) polymer, and are desirably designed to interlock to form an integral structure. Front cover 16 of housing assembly 12 is preferably molded with reinforcing bosses and ribs 18 to provide additional structural integrity.

Front cover 16 of housing assembly 12 includes square apertures 24 for receiving locking pins to be subsequently described in addition to a circular aperture 26 for receiving a lock to be subsequently described. Back cover 14 of housing 12 includes apertures 28 for use in mounting housing assembly 12 to a wall or other rigid structure.

Mounting plate 32 includes apertures 34, which are in alignment with apertures 28 of back cover 14. Mounting plate 32 is preferably made of metal plate, such as steel, to provide a strong anchor between housing assembly 12 of security rack 10 and the underlying wall or support surface. Bolts 38 are inserted through apertures 34 in mounting plate 32, through apertures 28 in back cover 14, and then into the wall or other support surface. Bolts 38 are desirably sized and the mounting surface behind back cover 14 is desirably selected so that mounting plate 32 and back cover 14 are firmly anchored to the support surface and cannot be pulled away from the support surface by the application of manual force. Front cover 16 is mechanically affixed to mounting plate 32 utilizing bolts 40 which pass through apertures 42 within front cover 16 to be received by threaded apertures 44 within mounting plate 32.

Guides 52 are provided to establish a strong mechanical lock between mounting plate 32, which is in turn anchored by bolts 38 to the underlying support surface, and slide bar 62. Guides 52 cooperate with apertures 66 and slots 68 to maintain slide bar 62 in sliding engagement with mounting plate 32, but to prevent slide bar 62 from being pulled away from mounting plate 32 once housing assembly 12 is fully assembled. Heads 58 of guides 52 preferably have a diameter greater than the outer diameter of notched portions 54, and greater than the diameter of apertures 50.

Prior to bolting mounting plate 32 and back cover 14 to the wall or other support surface, guides 52 are preferably inserted through apertures 50 so that heads 58 remain between mounting plate 32 and back cover 14. Recesses 57 can be molded or otherwise fabricated into back cover 14 to accommodate heads 58 when mounting plate 32 and back cover 14 are anchored by bolts 38.

Slide bar 62 is assembled into sliding engagement with mounting plate 32 by inserting notched portions 54 of guides 52 through apertures 66 of slide bar 62 and then sliding slide bar 62 sideways until elongate slots 68 engage notched portions 54 to prevent slide bar 62 from being pulled away from mounting plate 32. Apertures 66 are preferably disposed in slide bar 62 in such position that they can only be aligned with guides 52 when front cover 16 is removed from back cover 14 of housing assembly 12 and when none of the locking pins described below are engaged with slide bar 62. The position of, and range of travel permitted by, slots 68 is preferably such that guides 52 will not become aligned with apertures 66 at any time during the normal operation of security rack 10 once it has been installed.

An important aspect of the present invention is the use of a slide bar 62 which is mounted within housing assembly 12 for longitudinal and slidable movement therein. Slide bar 62 moves between an open position as illustrated in FIG. 1 and slides to a closed position in the direction indicated by arrow 64 in order to lock objects to mounting plate 32. Slide bar 62 further includes square apertures 74 and a slotted aperture 76 which is contiguous with square aperture 74. In the open position of slide bar 62, square apertures 74 are in alignment with square apertures 24 of front cover 16. In the closed position of slide bar 62, slotted apertures 76 are in alignment with square apertures 24 of front cover 16 of housing 12. FIG. 1 illustrates slide bar 62 in the open position where apertures 74 and apertures 24 are in alignment. Sliding of slide bar 62 in the direction of arrow 64 results in the misalignment of apertures 74 and apertures 24.

Slidable movement of slide bar 62 is accomplished through the operation of a lock, generally identified by the numeral 80. Lock 80 includes a lock cylinder 82 and a shaft 84. Lock 80 is received within circular aperture 26 of front cover 16. The outwardly facing surface of front cover 16 is preferably molded with a countersink into reinforcing ribs 18 around aperture 26 so that lock 80 will not extend outwardly beyond the surface of front cover 16 when security rack 10 is fully assembled. Recessing lock 80 in front cover 16 in this manner helps prevent a thief from chiseling the top off the lock. Lock 80 is preferably maintained in position relative to front cover 16 by retainer ring 88, which is desirably threaded onto lock cylinder 82 after lock 80 is inserted through aperture 26.

Shaft 84 of lock 80 extends through eccentric aperture 86 of slide bar 32. Cam 92 is mounted on shaft 84 and secured there by nut 90 in such manner that cam 92 remains disposed within eccentric aperture 86. Cam 92 and eccentric aperture 86 are cooperatively adapted to cause slide bar 62 to slide sideways whenever shaft 84 is rotated by the action of key 96 in lock 80. When the internals of lock cylinder 82 are rotated to a locked position by key 96, shaft 84 preferably causes cam 92 to rotate 90 degrees, and thereby moves slide bar 62 in the direction of arrow 64 to the closed position.

In order to mount an object or weapon to housing 12, a variety of locking pins are utilized for engaging the object or weapon and engaging slide bar 62 within housing assembly 12. Three such locking pins are illustrated in FIGS. 1 and 2 for locking a handgun 100 and long guns 102 to housing assembly 12 as illustrated in FIG. 2.

A locking pin 104 is utilized for locking handgun 100 to housing assembly 12. Locking pin 104 includes a shaft 106 which passes through the trigger guard of gun 100. Attached to shaft 106 is a plate 108 which prevents the removal of handgun 100 from locking pin 104 when locking pin 104 is secured within housing 12. Extending from shaft 106 is a locking shaft 112 including a notch 114. Locking shaft 112 is square for mating with apertures 24 of front cover 16 to thereby prevent rotation of locking pin 104. Locking shaft 112 is received by aperture 74 within slide bar 62 in the open position of slide bar 62. Notch 114 is received by slotted aperture 76 when slide bar 62 is moved to the closed position in the direction of arrow 64. In this manner, in the closed position of slide bar 62, slide bar 62 prevents the removal of locking pin 104 from housing assembly 12 in order to secure handgun 100 to housing assembly 12. Through operation of lock 80, slide bar 62 captures locking shaft 112 by engaging notch 114 of locking pin 104 to prevent the removal of locking pin 104 and handgun 100 from housing assembly 12.

Long guns 102 may be mounted to housing assembly 12 utilizing a locking pin 120. Locking pin 120 includes a U-shaped portion 124 which engages the stock grip of long gun 102. Alternatively, U-shaped portion 124 may also pass through the trigger guard and around the stock grip of a long gun 102. Long guns 102 are positioned such that the butt plate rests on the floor located adjacent to the wall to which housing assembly 12 is mounted. Locking pin 120 includes a locking shaft 126 having a notch 128. Locking shaft, as with the case of locking shaft 112 is square to be received by apertures 24 of front cover 16 of housing assembly 12 as well as square apertures 74 of slide bar 62. Notch 128 is received by slotted aperture 76 of slide bar 62 in the closed position of slide bar 62.

A further locking pin 134 is illustrated for use around a barrel of a long gun 102. Locking pin 134 may be used in combination with locking pin 120 for long guns 102. Locking pin 134 includes a ring portion 136 which receives the barrel of a long gun 102. Interconnected to ring portion 136 is a locking shaft 138 which is square, and which is received by square aperture 24 of front cover 16 of housing 12 as well as square aperture 74 of slide bar 62 in the open position of slide bar 62. Locking shaft 138 includes a notch 140 which is received within slotted aperture 76 of slide bar 62 in the closed position of slide bar 62.

Housing assembly 12 may be configured with any number of apertures 24 for receiving multiple locking pins 104, 120 or 134 for securing multiple weapons to housing assembly 12. Additionally, as illustrated in FIG. 2, multiple housing assemblies 12 may be utilized for providing additional security in securing weapons to security rack 10. Security rack 10 may be configured for securing a single weapon or multiple weapons as illustrated in FIGS. 1 and 2. The present configuration provides for a secure rack in that front cover 16 of housing 12 cannot be removed when slide bar 62 is in the closed position since apertures 24 and apertures 74 are misaligned and it is required to remove the locking pins prior to removal of front cover 16. Therefore, disassembly of housing assembly 12 as well as removal of a weapon must be accomplished utilizing key 96 in lock 80.

In order to prevent damage to weapons secured to security rack 10, the outwardly extending ends of locking pins 104, 120 and 134 may be plastic coated to prevent metal from contacting weapons 100 and 102.

It therefore can be seen that the present security rack allows for the securing of multiple weapons in an easy manner and which provides for a secure mechanism for displaying and mounting weapons to a fixed structure.

Whereas the present invention has been described with respect to specific embodiments thereof, it will be appreciated that various changes and modifications will be suggested to one skilled in the art, and it is intended to encompass such changes and modifications as fall within the scope of the appended claims.

I claim:

1. A security rack for weapons having trigger guards, barrels or stock grips comprising:

a housing assembly including a cover with an aperture;

an elongated slide bar longitudinally slidably mounted within said housing assembly for movement between an open position and a closed position;

said slide bar including an aperture selectively alignable with said cover aperture in said slide bar open position;

a locking pin including a shaft having first and second ends, said first end including means for engaging the weapon and said second end includes a notch for passing through said cover aperture and said slide bar aperture when said apertures are aligned in said slide bar open position, and for engaging said slide bar aperture when said cover aperture and slide bar aperture are misaligned in said closed position to thereby prevent removal of said locking pin from said housing assembly; and locking means for engaging said slide bar and accessible through said cover for moving said slide bar between said open and closed positions thereby allowing insertion and removal of said locking pin from said housing assembly in said open position and locking of said locking pin to said slide bar in said closed position thereby preventing removal of the weapon from the security rack;

wherein said shaft is square shaped in cross-sectional area and said aperture in said housing and said aperture in said slide bar are square shaped, thereby preventing rotation of said locking pin in said housing assembly.

2. A security rack for weapons having trigger guards, barrels or stock grips comprising:

a housing including an aperture;

an elongated slide bar longitudinally slidably mounted to said housing for movement between an open position and a closed position;

said slide bar including an aperture selectively alignable with said housing aperture in said slide bar open position;

a locking pin including a shaft having first and second ends, said first end including means for engaging the weapon and said second end including a notch for passing through said housing aperture and said slide bar aperture when said apertures are aligned in said slide bar open position, ad for engaging said slide bar aperture when said housing aperture and slide bar aperture are misaligned in said closed position to thereby prevent removal of said locking pin from said housing;

locking means for engaging said slide bar and accessible through said housing for moving said slide bar between said open and closed positions thereby allowing insertion and removal of said locking pin from said housing in said open position and locking of said locking pin to said slide bar in said closed position thereby preventing removal of the weapon from the security rack;

said slide bar aperture includes a square aperture for receiving said locking pin shaft second end in said open position and a contiguous slotted aperture for receiving said locking pin notch in said closed position;

said locking pin shaft being square shaped in cross-sectional area and including a top and bottom surface;

said aperture in said housing and said aperture in said slide bar are square shaped thereby preventing rotation of said locking pin in said housing; and said locking means includes a shaft extending through said housing and a cam mounted to said shaft, said slide bar including an aperture for receiving said cam for rotation within said aperture for moving said slide bar between said open position and said closed position upon rotation of said locking means shaft.

3. The security rack of claim 2 wherein said locking means includes a key operated locking mechanism including a lock cylinder interconnected to said cam.

4. The security rack of claim 2 wherein said locking pin notch includes a groove for mating with said top and bottom surfaces of said locking pin shaft.

5. The security rack of claim 2 wherein said weapon engaging means includes a plate for engaging the weapon and wherein said locking pin shaft extends through the trigger guard of the weapon.

6. The security rack of claim 2 wherein said weapon engaging means includes a U-shaped hook for engaging the stock grip or trigger guard of the weapon.

7. The security rack of claim 2 wherein said weapon engaging means includes a ring for encircling the barrel of the weapon.

* * * * *